US005447310A

United States Patent [19]

Jernigan

[11] Patent Number: 5,447,310

[45] Date of Patent: Sep. 5, 1995

[54] PUTTER

[76] Inventor: Doyle D. Jernigan, 3639 Rolling, Forest Spring, Tex. 77388

[21] Appl. No.: 236,920

[22] Filed: Apr. 29, 1994

[51] Int. Cl.[6] ..... A63B 53/04

[52] U.S. Cl. ..... 273/171; 273/167 C; 273/167 F; 273/167 H

[58] Field of Search ..... 273/167 R, 167 A, 167 B, 273/167 C, 167 D, 167 F, 167 G, 168, 167 J, 167 H, 169, 170, 171, 172, 173, 174, 175, 77 R, 77 A, 80.2, 80 C, 193 R, 194 R, 164.1, 164.2; D21/210, 211, 217, 218

[56] References Cited

U.S. PATENT DOCUMENTS

| | | | |
|---|---|---|---|
| 3,749,407 | 7/1973 | Prochnow | 273/162 E |
| 3,909,005 | 9/1975 | Piszel | 273/171 |
| 4,253,667 | 3/1981 | Clark | 273/171 |
| 4,444,395 | 4/1984 | Reiss | 273/171 |
| 4,508,342 | 4/1985 | Drake | 273/167 C |
| 4,655,459 | 4/1987 | Antonious | 273/171 |
| 4,861,038 | 8/1989 | Funicato | 273/167 C |
| 4,872,684 | 10/1989 | Dippel | 273/167 C |
| 4,962,932 | 10/1990 | Anderson | 273/171 |
| 5,090,698 | 2/1992 | Kleinfelter | 273/167 C |
| 5,190,290 | 3/1993 | Take | 273/171 |
| 5,193,806 | 3/1993 | Burkly | 273/167 C |
| 5,244,210 | 9/1993 | Au | 273/164.1 |

FOREIGN PATENT DOCUMENTS

| | | | |
|---|---|---|---|
| 1470768 | 4/1977 | United Kingdom | 273/171 |

OTHER PUBLICATIONS

Askeland, Donald R., "The Science and Engineering of Materials", 1984 by Wadsworth, Inc., p. 478.

*Primary Examiner*—Sebastiano Passaniti

*Attorney, Agent, or Firm*—Sue Z. Shaper; Butler & Binion

[57] ABSTRACT

A putter with an improved putting head comprising a rounded striking surface and having heel and toe portions of greater weight than equivalently sized central portions.

14 Claims, 1 Drawing Sheet

FIG. 1
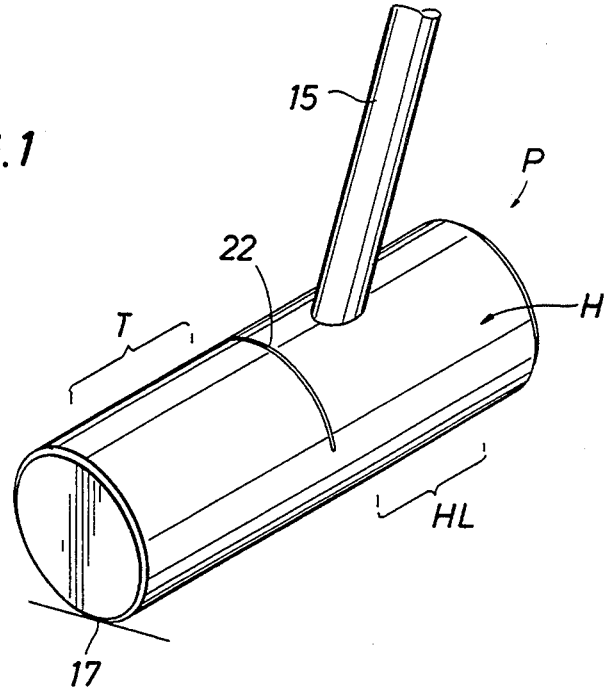
FIG. 3
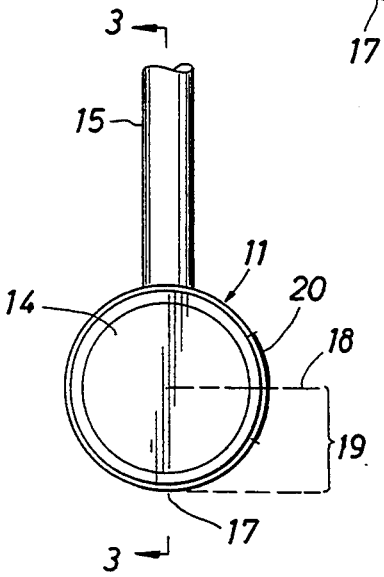
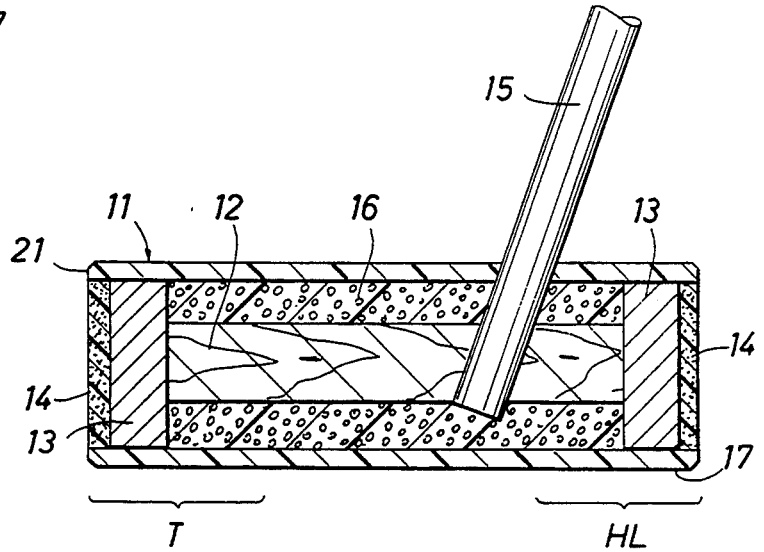
FIG. 2
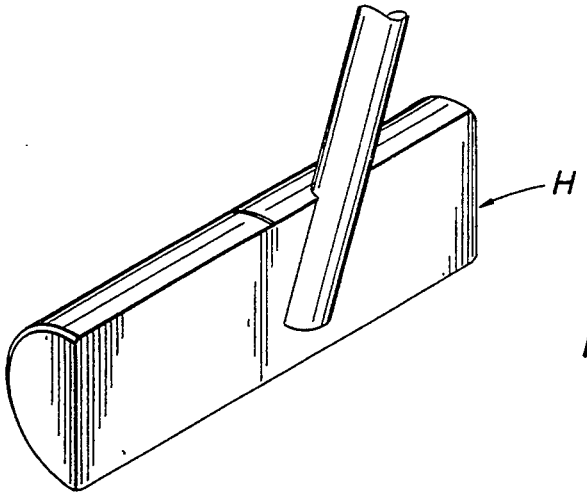
FIG. 4

PUTTER

FIELD OF THE INVENTION

The invention relates to an improved putter, and more particularly, to a novel putting head.

BACKGROUND OF INVENTION

Golf has become a well known sport in the last century. During that period of time, various types of clubs have been developed. As putting is very important to the game, there exist many types and varieties of putters. Most of them are comprised of cast or forged heads with a steel graphite shaft.

The putter of the present invention distinguishes itself in that it presents a rounded striking face combined with heel and toe weighting. The heel and toe weighting results in diminishing weight progressing toward the center of the head to give a "sweet spot" effect over the entire length of putter. The rounded striking face results in the ball leaving the face of the putter faster than from conventional putters due to the impact response from the curved surface. In particular, use of PVC pipe filled with precisely weighted lead material for the putting head improves the impact response. The use of weighted PVC pipe has proven to result in a superior rebound and resilience of the head together with a superior feel and coefficient of friction.

The roundness of the ball contact surface helps prevent underspin, scooting or skidding. The ball starts rolling immediately and tends to hug the surface, due, in part, to the small surface of the contact area and to the absence of any upward angle of force being imparted at the contact point. The rounded cylindrical head further lessens the effect of any dragging on greens. The method of weighing of the present invention, using lead plugs in the heel and toe area and precise weighting in the annular central region, aids in making the ball go straight.

A further feature of the cylindrical putter is that the same putter can be used by right or left-handed players.

SUMMARY OF THE INVENTION

The present invention comprises a putter with a shaft attached to a putting head. The putting head includes a rounded striking surface located at an approximate golf ball radius above the bottom of the head. The heel portion and toe portion of the head, as the two end portions of the head are referred to in the art, are structured to have greater weight than equivalently sized central portions. Preferably, the heel and toe portions, if viewed as comprising approximately one-quarter of the length of the head in combination, would comprise at least one-third of the weight of the head. Preferably also, the rounded striking surface has a radius of curvature similar to the radius of curvature of a golf ball.

In one preferred embodiment the putting head comprises at least a partial cylinder having an outside diameter of between 1⅛ inches and 1½ inches. More preferably, the outside diameter is approximately 15/16 inches.

In particular, in a preferred embodiment, the putting head comprises an approximate 4 inch length of PVC pipe filled with suitable material. Preferred filler material includes discs of lead located in the heel portion and the toe portion, a wooden dowel located longitudinally in the center, and lead particles, or lead shot, fixed in epoxy filling the annular region between the dowel and the inside of the pipe. The wooden dowel could be replaced with an approximately sized piece of PVC pipe, or any of several other appropriately shaped materials.

BRIEF DESCRIPTION OF DRAWINGS

FIG. 1 offers a side view of a head portion of a putter.

FIG. 2 offers an end view of a head portion of a putter.

FIG. 3 offers a cut-a-way sectional view of a head portion of the putter of FIGS. 1 and 2.

FIG. 4 offers an alternative embodiment side view of a head portion of a putter.

DESCRIPTION OF PREFERRED EMBODIMENTS

FIG. 1 illustrates a side view and FIG. 2 illustrates an end view of a preferred embodiment of the present invention. The head end of putter P is illustrated in FIG. 1 as having shaft 15 and cylindrical head H. Line 22 of FIG. 1 illustrates a sight line for visual referencing, illustrated as etched on the top of the head of the preferred embodiment. Point 17 indicates the bottom of the putting head, suggested to be resting upon the ground in FIG. 1.

FIG. 2 illustrates an end view of putter P of FIG. 1. Point 17, again, indicates the bottom of the putting head H. Line 18 indicates a measure of the outside diameter of putting head H. Line 19 indicates a measure of the radius of putting head H. Area 20 indicates the effective rounded striking surface of the embodiment. Of course, in the putter of the illustrated embodiment, effective rounded striking surface 20 would exist on both sides of cylindrical head H, depending upon whether the putter were being used by a right-handed or a left-handed person.

Although the preferred embodiment teaches a putting head comprised of a length of PVC pipe, the head need not be completely cylindrical. Only a curved striking surface is required. The head of the putter could be effectively trunkated, as illustrated by FIG. 4. A fully cylindrical putter has several advantages, however, including being usable both by right and left-handed players. In the preferred embodiment, the radius of putting head H is shown as radius 19 and is similar to the radius of a golf ball. It is believed desirable for the radius of curvature of the striking surface of putting head H to be substantially similar to the radius of curvature of a golf ball.

In the art the far end of the putting head is referred to generally as the toe. Toe T is illustrated in FIGS. 1 and 3. The shaft end of the putting head is referred to as the heel of the head. Heel HL is also indicated in FIGS. 1 and 3. The extent of the length of the toe and heel portions of a putting head is not particularly defined.

The cutaway illustration of FIG. 3 illustrates the weighting and construction of a preferred embodiment of the present invention. In FIG. 3, pipe 11 is comprised of a 15/16 outside diameter piece of PVC pipe, approximately 4 inches long with a ⅛th inch wall thickness. Centrally located cylindrical shaped piece 12 in the preferred embodiment is comprised of a ½ inch diameter hardwood dowel. Alternately, a piece of PVC pipe could be used. Discs 13 of FIG. 3 are comprised of 1 inch diameter and ⅜ inch thick lead plugs. Lead plugs 13 are secured inside head: H by means of poured and cured epoxy plugs 14, themselves shown with ⅛ inch thickness and approximately 1 inch diameter. They may be colored. FIG. 3 indicates that the annular region between interior dowel 12 and the inside wall of pipe 11 is filled with lead shot frozen in epoxy. Shaft 15 is comprised of a 0.355 diameter shaft inserted $\frac{3}{4}$ of an inch into the putter at the correct angle for the heighth of the customer. The putting head H is typically finished by bevelling the outside rims 21 of pipe 11.

The standard weight for a putter is approximately 340 grams. This weight can be varied for customers from 200 grams to 400 grams. The example of FIG. 3 illustrates a putter with an approximate total weight of 340 grams. Of that weight the contribution of the epoxy is negligible. The wood core would weigh approximately 9 grams. The PVC cylinder would weight approximately 46 grams. The lead disc plugs would weigh approximately 60.5 grams each. Number 9 lead shot used in the annular region would weigh approximately 164 grams. If the heel and toe region of the embodiment of FIG. 3 were defined to contain the region comprising the lead disk 13 and epoxy plug 14, then the heel and toe region of the illustration of FIG. 3 would comprise, in combination, approximately $\frac{1}{4}$ of the total length of the putting head. That heel and toe region would comprise, by weight, approximately 132.5 grams. As such the heel and toe region would comprise greater than $\frac{1}{3}$, and in fact almost 40%, of the total weight of the head.

The foregoing disclosure and description of the invention are illustrative and explanatory thereof. Various changes in the size, shape and materials as well as the details of the illustrated construction may be made without departing from the spirit of the invention.

What is claimed is:

1. A putter comprising a shaft attached to a putting head; the putting head comprising a length of PVC pipe for striking a ball and defining a cavity therethrough having center, heel and toe portions filled with weighted material; the weighted material of each said portions having a significantly greater density than the density of the pipe; the heel and toe portions being of greater weight than an equivalently-sized said center portion.

2. The apparatus of claim 1 wherein the heel and toe end portions comprise, in combination, approximately one-quarter of the length of the head and comprise, in combination, at least one-third of the weight of the head, and wherein the central three-quarters length of the head is uniformly weighted.

3. The apparatus of claim 1 wherein the pipe has a radius of curvature substantially similar to the radius of curvature of a golf ball.

4. The apparatus of claim 1 wherein the pipe has an outside diameter between $1\frac{1}{8}$ inches and $1\frac{1}{2}$ inches.

5. The putting head of claim 4 wherein the outside diameter is approximately 15/16 inches.

6. The putting head of claim 4 wherein the length of pipe comprises a partial cylinder.

7. The apparatus of claim 1 wherein the weighted filler material includes a disc of lead located in each of the heel portion and the toe portion of the head.

8. The apparatus of claim 1 wherein the weighted filler material includes lead particles fixed in epoxy distributed within at least an annular central portion of the pipe.

9. The apparatus of claim 1 wherein the weighted filler material includes a wooden dowel.

10. The apparatus of claim 1 wherein the weighted filler material includes a portion of lead located in the heel portion and in the toe portion of the head, a wooden dowel longitudinally located in the center of the pipe and includes lead particles fixed in epoxy located in the annular region between the wooden dowel and the inside wall of the pipe.

11. The apparatus of claim 8 wherein the lead particles comprise lead shot.

12. The apparatus of claim 1 wherein the weighted filler material includes a second portion of PVC pipe.

13. A putter comprising a shaft attached to a non-uniformly weighted at least partially cylindrical pipe means for striking a ball and filled with a weighted filler material; the pipe means being weighted in center and end portions; the weighted filler material having a significantly greater density than the density of the pipe means; the end portions of the pipe means being weighted greater than an equivalently-sized said center portion.

14. The putter of claim 13 wherein the pipe comprises PVC pipe.

* * * * *

UNITED STATES PATENT AND TRADEMARK OFFICE

CERTIFICATE OF CORRECTION

PATENT NO. : 5,447,310

DATED : September 5, 1995

INVENTOR(S) : Doyle D. Jernigan

It is certified that error appears in the above-identified patent and that said Letters Patent is hereby corrected as shown below:

COLUMN 4, LINE 10 Delete [15/16] and insert -- 1-5/16 --

Signed and Sealed this

Second Day of January, 1996

Bruce Lehman

*Attest:*

BRUCE LEHMAN

*Attesting Officer*

*Commissioner of Patents and Trademarks*